United States Patent [19]

Cape

[11] Patent Number: 4,828,615

[45] Date of Patent: May 9, 1989

[54] PROCESS AND COMPOSITION FOR SEALING A CONVERSION COATED SURFACE WITH A SOLUTION CONTAINING VANADIUM

[75] Inventor: Thomas W. Cape, Bloomfield, Mich.

[73] Assignee: Chemfil Corporation, Troy, Mich.

[21] Appl. No.: 28,922

[22] Filed: Mar. 23, 1987

Related U.S. Application Data

[63] Continuation of Ser. No. 822,507, Jan. 27, 1986, abandoned.

[51] Int. Cl.[4] ..... C23C 18/46

[52] U.S. Cl. ..... 106/14.13; 106/14.14; 106/14.21; 106/14.44

[58] Field of Search ..... 106/14.05, 14.13, 14.17, 106/14.44, 14.14, 14.21; 148/6.14 R, 6.15 R

[56] References Cited

U.S. PATENT DOCUMENTS

| | | | |
|---|---|---|---|
| 2,989,448 | 6/1961 | France | 204/44 |
| 3,930,081 | 12/1975 | Shinomiya | 427/421 |
| 4,039,582 | 8/1977 | Nasyrov | 423/592 |
| 4,233,088 | 11/1980 | Kronstein | 148/6.16 |
| 4,298,404 | 11/1981 | Greene | 148/6.14 A |
| 4,485,190 | 11/1984 | Sherif | 502/243 |
| 4,548,792 | 10/1985 | Rodriguez | 423/65 |
| 4,610,732 | 9/1986 | Sasaki | 148/6.14 R |

*Primary Examiner*—Paul Lieberman
*Assistant Examiner*—Kathleen Markowski
*Attorney, Agent, or Firm*—Godfried R. Akorli

[57] ABSTRACT

A solution containing pentavalent vanadium is applied to a metal surface subsequent to conversion coating. The solution contains pentavalent vanadium ions which may be obtained from a sodium metavanadate or sodium metavanadate/orthovanadate solution that is acidified with an acid. Vanadium pentoxide may be dissolved in a base such as sodium hydroxide, potassium hydroxide or lithium hydroxide to form a basic concentrate which can be acidified conveniently after dilution. In one disclosed embodiment, the solution comprises vanadium pentoxide, sodium hydroxide, nitric acid and water which is applied to a phosphate conversion coated surface than rinsed with deionized water prior to priming and painting.

13 Claims, No Drawings

PROCESS AND COMPOSITION FOR SEALING A CONVERSION COATED SURFACE WITH A SOLUTION CONTAINING VANADIUM

This is a continuation of application Ser. No. 822,507, filed Jan. 27, 1986, now abandoned.

BACKGROUND OF THE INVENTION

This invention relates generally to rinsing or sealing metal surfaces subsequent to conversion coating, and more particularly concerns improving the corrosion resistance of conversion coated surfaces with a solution that minimizes disposal problems.

In the metal finishing industry it is well known to use a zinc phosphate or iron phosphate conversion coating on a metal surface to promote adhesion of paint or other finishes. The corrosion resistance of conversion coatings may be improved by the use of a rinse subsequent to conversion coating with a solution for sealing the conversion coated surface. Rinses including chromic acid or a chromate compound are known to be effective when used as rinse additives to seal the metal and improve corrosion resistance of the conversion coating. The primary problem with the use of chromate final rinses is their classification as toxic chemicals. Chromium (III) final rinses have been developed and are preferred due to their lower toxicity. The primary inpetus for developing non-chrome rinses is the problem of disposing of waste residue in a safe manner.

Considerable work has been done to develop a non-chromium sealer for conversion coated surfaces. Polymer-based sealers have been proposed but have generally not been as effective in terms of corrosion resistance and cost effectiveness as chromate sealers. Another approach has been to apply a solution of non-metallic ions to a conversion coated surface. Non-metallic ion solutions proposed include solutions of phosphates, phosphonates, flourides and silica with certain quaternary amines. Another alternative to the chromium final rinses that has been proposed is the use of a solution of metal ions such as zirconimum, titanium peroxide, molybdenum, aluminum, permangenate and the rare earth elements. The above proposed replacements for chromium final rinses have been less effective than chromium final rinses when tested in cyclical tests and other accelerated corrosion tests that are generally considered more realistic than salt spray testing.

In addition to corrosion resistance, with modern automobile assembly line paint systems it is important that a sealer following phosphate be effective in promoting adhesion when used with cathodically electro-deposited paints. Some of the above replacements for chromium final rinses have not provided equivalent paint adhesion improvement when used with a cathodically electro-deposited paint system.

The present invention is directed to overcoming the problems set forth above.

SUMMARY OF THE INVENTION

The composition of the present invention comprises an aqueous solution having a vanadium containing compound, a base for solublizing the vanadium compound and a strong acid for maximizing the concentration of the active form of vanadium.

In its process aspects the invention involves the steps of wetting a conversion coated metal to improve its corrosion resistance with a composition consisting essentially of an acidic solution containing at least one vanadium compound dissolved in a base and acidified by an acid, and then rinsing the sealer from the surface with a deionized water rinse. The sealer may be prepared as a one or more part system wherein each part is supplied to a much larger relative volume of water and neutralized if required. The sealant of the present invention may be applied to the conversion coated metal surface by either spray or immersion, preferably at room temperature for about thirty seconds.

It is theorized that the vanadium species in the solution of the present invention is primarily the decavanadate ion $HV_{10}O_{28}^{4-}$ which is intended to seal the pores where bare metal is exposed through the phosphate coating. The other decavanadate ions $H_2V_{10}O_{28}^{5-}$ and $V_{10}O_{28}^{6-}$ may be present in the solution and may also be effective. In this way, the present invention is believed to function similar to a chromate final rinse to obtain optimum corrosion resistance and optimum paint adhesion.

The present invention eliminates the use of chromium solutions on metal surfaces subsequent to conversion coating and achieves equivalent corrosion resistance to known chromium based sealers. The corrosion resistance of the sealer of the present invention is effective under automotive test conditions including salt spray tests, accelerated corrosion tests, and outdoor scab tests where prior art formulations have not been as effective as chromium containing sealers.

The present invention has also proven effective in promoting adhesion of cathodically electro-deposited primers and paints.

DETAILED DESCRIPTION OF THE INVENTION

The composition of the present invention, which is used in the treatment of metal surfaces as a final rinse following conversion coating, preferably is an aqueous solution of between 10 to 1000 parts per million of pentavalent vanadium. The pentavalent vanadium is preferably prepared by combining in an aqueous solution a base for solublizing a vanadium compound and an acid for lowering the pH of the solution.

| | |
|---|---|
| $V_2O_5$ | vanadium pentoxide |
| $NH_4VO_3$ | ammonium meta-vanadate, ammonium vanadate |
| $NaVO_3$ | sodium meta-vanadate (alkali metal meta-vanadate) |
| $VOSO_4$ | vanadyl sulfate |
| $VF_5$ | vanadium pentafluoride |
| $Na_3VO_4$ | sodium ortho-vanadate (alkali metal ortho-vanadate |
| $V_2O_4$ | vanadium tetroxide |
| $VCl_4$ | vanadium tetrachloride |
| $VFl_4$ | vanadium tetrafluoride |
| $VCl_3$ | vanadium trichloride |
| $VOCl_3$ | vanadium oxy trichloride |
| $(VO)^{2+}X_N$ | vanadyl containing species |
| $VCl_2$ | vanadium dichloride |
| V | vanadium metal |

The vanadium compound may be obtained from at least one of the following vanadium sources:

The preparation of a one component concentrate is preferably accomplished by preparing a sodium metavanadate or sodium metavanadate/orthovanadate solution and adding a concentrated acid. The sodium metavanadate solution could be formed by one or more of the following methods:

(1) dissolving sodium metavanadate solid;
(2) dissolving vanadium pentoxide with a twice equal molar volume of sodium hydroxide;
(3) dissolving a reduced vanadium compound with one mole sodium hydroxide per mole of vanadium and oxidizing the mixture; or
(4) a combination of two or more of the above methods.

To prepare a sodium metavanadate/orthovanadate solution, any one of the above methods may be used, however, a greater proportion of sodium hydroxide is required. Alternatively, hydrogen peroxide or an equivalent inorganic peroxide may be added to enhance solubility. Other strong oxidizers which can be added to assist in dissolution of the vanadium compound or oxidize a reduced form of vanadium to the fully oxidized form include alkali metal peroxides, chlorine, fluorine, ozone, perborate, percarbonate or persulfate.

The alkaline vanadate solution resulting from the above steps is neutralized with a concentrated acid. If the acid is reduced by the vanadium, then oxidizers may be added to the solution.

In addition to sodium hydroxide, bases such as: potassium hydroxide; ammonium hydroxide; or other strong bases may be used.

Acids that have been used to neutralize the alkaline vanadate solution are nitric acid, sulfuric acid, hydroflouric acid, flouroboric acid, phosphoric acid, perchloric acid, citric acid, glycolic acid, oxalic acid, phytic acid and combinations of the above. The preferred pH of the working bath is between about 4.0 and 4.5. If the acid is reduced by the vanadium, an oxidizing agent such as hydrogen peroxide, ozone or inorganic peroxides, for example, percarbonates, persulfates and perborates, should be added to the solution. The acids may be added separately to the vanadate rinse solution bath in order to directly control the pH of the bath.

A metavanadate solution could also be prepared from potassium or ammonium ions of vanadium, however, due to the lower solubilities of these compounds the concentrated solutions would necessarily be more dilute than the concentrated solutions based on sodium metavanadate.

Another method of preparing a one component system would be by dissolving ammonium vanadate or vanadium pentoxide in acid, preferably hydroflouric acid, and neutralizing the acid vanadate solution with an alkali such as sodium carbonate, sodium hydroxide, potassium hydroxide, ammonium hydroxide, biammonium carbonate to adjust pH.

In a two component system, an acidic vanadium solution may be neutralized by separately adding an alkaline solution.

One or more of the following mineral acids are believed to be usable in preparing the concentrate for the composition of the present invention:

| | |
|---|---|
| $HNO_3$ | nitric acid |
| $H_3PO_4$ | phosphoric acid |
| $H_2SO_4$ | sulfuric acid |
| $HBF_4$ | fluoroboric acid |
| HF | hydroflouric acid |
| HCl | hydrochloric acid |
| HBr | hydrobromic acid |
| HI | hydroiodic acid |
| $H_2SiF_6$ | fluosilicic acid |
| $HPF_6$ | hexaflouro phosphoric acid |
| $HClO_4$ | perchloric acid |
| $NH_4HF_2$ | ammonium bifluoride |
| $H_2PO_3F$ | monofluoro phosphoric acid |
| $HPF_6$ | hexafluoro phosphoric acid |
| $HBrO_4$ | perbromic acid |
| $HIO_4$ | periodic acid |
| $HSO_3NH_2$ | sulfamic acid |

Organic acids including but not limited to phytic acid, sulfonic and carboxylic acids may also be used in the present invention. Carboxylic acids including acetic acid, oxalic acid, glycolic acid and citric acid require the addition of an oxidizing agent such as hydrogen peroxide. Partially neutralized acids such as ammonium bifluoride or sodium bisulfate may also be used.

Vanadium pentoxide or other vanadium species may be added to the base used in neutralization to form a vanadium-containing base. Bases that are believed to be usable include but are not limited to:

| | |
|---|---|
| NaOH | sodium hydroxide |
| KOH | potassium hydroxide |
| $NH_4OH$ | ammonium hydroxide |
| $Na_2CO_3$ | sodium carbonate |
| $NaVO_3$ | sodium meta-vanadate |
| $Na_3VO_4$ | sodium ortho-vanadate |
| $NH_4VO_3$ | ammonium meta-vanadate |
| $(NH_4)_2CO_3$ | diammonium carbonate |

The preferred working bath formula is:

| Name of raw material | Chemical formula | Best % | Preferred range % | Broad range % |
|---|---|---|---|---|
| Vanadium Pentoxide | $V_2O_5$ | 0.018% | 0.005%-0.04% | 0.0018%-0.18% |
| Sodium Hydroxide | NaOH | 0.00875% | 0.004-0.045% | 0.0008-1.0% |
| Hydrogen Peroxide (30%) (30%) | $H_2O_2$ | 0.0015% | 0.001-0.005% | 0.0005-1.0% |
| Nitric Acid | $HNO_3$ | 0.0118% | 0.005-0.050% | 0.001-1.0% |
| Water | $H_2O$ | Balance | Balance | Balance |

The above working bath is preferably obtained by making a solution of sodium metavanadate which is adjusted to a pH of about 4.2 with nitric acid. Ammonium bifluoride may be used in the above working bath instead of nitric acid in substantially the same proportions. The solution is applied to phosphate conversion coated metal surfaces including iron, steel, zinc and aluminum. The phosphate conversion coating is produced by application of a known commercial phosphating solution.

A two-part concentrate system is preferred because it permits a more concentrated product to be prepared without forming a precipitate. If the acid and base/vanadate solution is combined in a single package, more than eight times as much water must be included as compared to a two-part system in which the acid is packaged separately from the base/vanadate solution. This is an important advantage for shipping and storing the product. In addition, a two-part system allows more convenient adjusting of the pH during operation.

As used herein, the term nominally, when used to describe the quantity of a material added to a solution, shall be construed to mean a range from half of the quantity specified to twice the quantity specified.

EXAMPLES

Steel test panels and galvanized test panels were cleaned first by wiping with a solvent based cleaner, commercially available available as Chemkleen 212, followed by spray application of an alkaline prephosphate cleaner, commercially available as Chemkleen 42, at 140° F. for sixty seconds. The panels were sprayed with a solution containing Jernstedt salts, commercially available as Rinse Conditioner from Chemfil Corporation, at 140° F. for sixty seconds. The panels were then phosphated with a zinc phosphate bath, commercially available as Chemfos 168, at 128° F. for sixty seconds and spray rinsed with ambient tap water for thirty seconds. The description of the panel processing contained in U.S. Pat. No. 4,330,345 is incorporated herein by reference.

The final rinse of the present invention was spray applied at room temperature for thirty seconds followed by a deionized water rinse at room temperature for fifteen seconds. The panels were then dried at 275° F. for five minutes. PPG Corporation's Uniprime ED 3150 was applied to the panels and baked. An enamel top coat, CIL-type, was applied and baked.

The following examples are of sealer compositions made in accordance with the present invention as concentrates which were diluted as indicated. Where multiple part examples are given, the parts are combined to prepare a solution having a pH in the above specified range.

| Material | Wt |
|---|---|
| $H_2O$ | Balance to 100 ml |
| NaOH (pellets) | 4.0 g |
| $V_2O_5$ | 0.9 g |
| $HNO_3$ | 8.5 g |

Dilution: 50:1 in water

EXAMPLE 2

| Material | Wt |
|---|---|
| $H_2O$ | Balance to 100 ml |
| NaOH (pellets) | 4.0 g |
| $V_2O_5$ | 1.8 g |
| $H_2O_2$ (30%) | 3.3 g |
| $HNO_3$ | 8.5 g |

Dilution: 100:1 in water

EXAMPLE 2a

| Part 1 | | Part 2 | |
|---|---|---|---|
| Material | Wt | Material | Wt |
| $H_2O$ | Balance to 400 ml | $H_2O$ | Balance to 100 ml |
| NaOH (pellets) | 28.0 g | $HNO_3$ | 34.0 g |
| $V_2O_5$ | 57.6 g | | |

-continued

| Part 1 | | Part 2 | |
|---|---|---|---|
| Material | Wt | Material | Wt |
| $H_2O_2$ | 4.8 g | | |

Dilution:
Part 1 800:1 in water
Part 2 2830:1 in water

EXAMPLE 3

| Material | Wt |
|---|---|
| $H_2O$ | Balance to 100 ml |
| NaOH | 4.0 g |
| $V_2O_5$ | 0.9 g |
| Glycolic Acid | 7.6 g |

Dilution: 50:1 in water

EXAMPLE 4

| Material | Wt |
|---|---|
| $H_2O$ | Balance to 100 ml |
| NaOH | 4.0 g |
| $V_2O_5$ | 3.6 g |
| Citric Acid | 15.4 g |

Dilution: 200:1 in water

EXAMPLE 5

| Part 1 | | Part 2 | |
|---|---|---|---|
| Material | Wt | Material | Wt |
| $H_2O$ | Balance to 100 ml | $H_2O_2$ | 100% |
| NaOH | 4.00 g | | |
| $V_2O_5$ | 3.61 g | | |
| Citric Acid | 15.4 g | | |

Dilution:
Part 1 200:1 in water
Part 2 1333:1 in water

EXAMPLE 6

| Part 1 | | Part 2 | |
|---|---|---|---|
| Material | Wt | Material | Wt |
| $H_2O$ | Balance to 100 ml | $H_2O_2$ (30%) | 100% |
| NaOH | 4.0 g | | |
| $V_2O_5$ | 3.6 g | | |
| Citric Acid | 15.4 g | | |

Dilution:
Part 1 200:1 in water
Part 2 667:1 in water

EXAMPLE 7

| Part 1 | | Part 2 | |
|---|---|---|---|
| Material | Wt | Material | Wt |
| $H_2O$ | Balance to 100 ml | $H_2O$ | Balance to 100 ml |
| NaOH | 4.00 g | $NaNO_3$ | 25.5 g |
| $V_2O_5$ | 3.6 g | | |

-continued

| Part 1 | | Part 2 | |
|---|---|---|---|
| Material | Wt | Material | Wt |
| Citric Acid | 15.4 g | | |

Dilution:
Part 1 200:1 in water
Part 2 500:1 in water

EXAMPLE 8

| Part 1 | | Part 2 | | Part 3 | |
|---|---|---|---|---|---|
| Material | Wt | Material | Wt | Material | Wt |
| $H_2O$ | Balance to 100 ml | $H_2O_2$ (30%) | 100% | $H_2O$ | Balance to 100 ml |
| NaOH | 4.0 g | | | Ammonium Molybdate | 17.5 g |
| $V_2O_5$ | 3.6 g | | | | |
| Citric Acid | 15.4 g | | | | |

Dilution:
Part 1 200:1 in water
Part 2 667:1 in water
Part 3 500:1 in water

EXAMPLE 9

| Part 1 | | Part 2 | | Part 3 | | Part 4 | |
|---|---|---|---|---|---|---|---|
| Material | Wt | Material | Wt | Material | Wt | Material | Wt |
| $H_2O$ | Balance to 100 ml | $H_2O_2$ (30%) | 100% | $H_2O$ | Balance to 100 ml | $H_2O$ | Balance to 100 ml |
| NaOH | 4.0 g | | | Ammonium Molybdate | 17.5 g | Titanium potassium oxalate | 3.5 g |
| $V_2O_5$ | 3.6 g | | | | | | |
| Citric Acid | 15.4 g | | | | | | |

Dilution:
Part 1 200:1 in water
Part 2 667:1 in water
Part 3 500:1 in water
Part 4 50:1 in water

EXAMPLE 10

| Part 1 | | Part 2 | |
|---|---|---|---|
| Material | Wt | Material | Wt |
| $H_2O$ | Balance to 100 ml | $H_2O_2$ (30%) | 100% |
| NaOH | 4.0 g | | |
| $V_2O_5$ | 0.9 g | | |
| Glycolic Acid | 7.6 g | | |

Dilution:
Part 1 50:1 in water
Part 2 1333:1 in water

EXAMPLE 11

| Part 1 | | Part 2 | |
|---|---|---|---|
| Material | Wt | Material | Wt |
| $H_2O$ | Balance to 100 ml | $H_2O$ | Balance to 100 ml |
| NaOH | 4.0 g | $Al(NO_3)_3$ $9H_2O$ | 37.5 g |
| $V_2O_5$ | 1.8 g | | |
| $H_2O_2$ (30%) | 3.3 g | | |
| $HNO_3$ | 8.5 g | | |

Dilution:
Part 1 100:1 in water
Part 2 250:1 in water

EXAMPLE 12

| Part 1 | | Part 2 | | Part 3 | |
|---|---|---|---|---|---|
| Material | Wt | Material | Wt | Material | Wt |
| $H_2O$ | Balance to 100 ml | $H_2O_2$ (30%) | 100% | $H_2O$ | Balance to 100 ml |
| NaOH | 4.0 g | | | $K_2TiO(C_2O_4)_2$ $2H_2O$ | 3.5 g |
| $V_2O_5$ | 0.9 g | | | | |
| $HNO_3$ | 8.5 g | | | | |

Dilution:
Part 1 50:1 in water
Part 2 1333:1 in water
Part 3 50:1 in water

EXAMPLE 13

| Part 1 | | Part 2 | |
|---|---|---|---|
| Material | Wt | Material | Wt |
| $H_2O$ | Balance to 400 ml | $H_2O$ | Balance to 100 ml |
| NaOH | 28.0 g | $NH_4HF_2$ | 34.2 g |
| $V_2O_5$ | 57.6 g | | |
| $H_2O_2$ | 4.8 g | | |

Dilution:
Part 1 800:1 in water
Part 2 2930:1 in water

TEST METHODS

The panels prepared as described above were subjected to four different testing procedures, the General Motors Scab Cycle (GSC), Ford Scab Cycle (FSC), Automatic Scab Cycle (ASC) and Outdoor Scab Cycle (OSC).

The GSC test is a four week test with each week of testing consisting of five twenty-four hour cycles comprising immersion in a 5% sodium chloride solution at room temperature followed by a 75 minute drying cycle at room temperature followed by 22.5 hours at 85% relative humidity at 140° F. The panels are maintained at 140° F. at 85% relative humidity over the two-day period to complete the week. Prior to testing, the test panels are scribed with a carbide tipped scribing tool. After the testing cycle is complete, the scribe is evaluated by simultaneously scraping the paint and blowing with an air gun. The test results were reported as rated from 0, indicating a total paint loss, to 5, indicating no paint loss.

The FSC test is the same as the GSC test except the test is for ten weeks and the temperature during the humidity exposure portion of the test is set at 120° F. and the scribe is evaluated by applying Scotch Brand 898 tape and removing it and rating as above.

The ASC test is comprised on 98 twelve hour cycles wherein each cycle consists of a four and three-quarter hour 95 to 100% humidity exposure followed by a 15 minute salt fog followed by seven hours of low humidity (less than 50 percent humidity) drying at 120° F. The ASC test is evaluated in the same way as the FSC test.

The most reliable test is the OSC test wherein a six-inch scribe is made on one-half of a panel and the other half is pre-conditioned in a gravelometer in accordance with SAE J 400. The panel is then exposed to salt spray for twenty-four hours which is followed by deionized water immersion for forty-eight hours. The panel is then placed outside at a forty-five degree angle southern exposure. A steel control panel, treated with the same conversion process except for the final rinse which was chrome (VI) final rinse, is tested simultaneously in the same manner. When the control panel exhibits a corrosion scab of about six millimeters, the panels are soaked for twenty-four hours. The OSC is evaluated according to the same procedure used for the FSC and ASC tests as described previously.

The test results are reported below as compared to identically prepared panels using a Cr (IV)/Cr (III) solution, commercially available as Chemseal 20 from Chemfil Corporation and Cr (III) solution, commercially available as Chemseal 18. The test results for the test are as follows:

TABLE I

TEST RESULTS TABLE FOR STEEL SUBSTRATES

| | Steel Substrate | | | | | | | |
|---|---|---|---|---|---|---|---|---|
| | GSC | | FSC | | ASC | | OSC | |
| Final Rinse | Creepage | Adhesion | Creepage | Adhesion | Creepage | Adhesion | Creepage | Adhesion |
| V (V) #1 | 4 mm | 5 | | | 8 mm | 5 | 6 mm | 4 |
| V (V) #2 | | | 3 mm | 5 | 8 mm | 5 | 7 mm | 5 |
| V (V) #2A | 4 mm | 5 | 3 mm | 5 | 6 mm | 5 | | |
| V (V) #3 | | | 3 mm | 5 | 9 mm | 5 | 7 mm | 5 |
| V (V) #4 | | | 3 mm | 5 | 8 mm | 5 | 8 mm | 5 |
| V (V) #13 | 4 mm | 5 | 2 mm | 5 | 5 mm | 5 | | |
| Positive Controls | | | | | | | | |
| Cr (VI)/Cr (III) | 4–5 mm | 5 | 3 mm | 5 | 6–9 mm | 5 | 6–7 mm | 5 |
| Cr (III) | 4 mm | 5 | 3 mm | 5 | 6–9 mm | 5 | 6 mm | 5 |
| Negative Controls | | | | | | | | |
| No Final Rinse | 4 mm | 5 | 3 mm | 5 | 6–10 mm | 5 | 6–7 mm | 5 |

KEY:

Creepage is measured in millimeters from scribe. Adhesion is on a scale of 0 to 5 with 5 being the best.

NOTE:

Ranges given for Chrome (III) and (VI)/(III) and no final rinse are the result of multiple tests of controls. Low creepage in ASC tests of V (V) #5 and #6 correspond with low creepage of 6 mm in controls.

CONCLUSION

All final rinses, the chrome final rinse and no final rinse performed substantially equally in all four of the above tests. The logical conclusion from this result is that these tests do not differentiate between effective final rinses and no final rinse. Thus, on steel, these tests only can be used to show that a treatment is or is not detrimental.

TABLE II

TEST RESULTS TABLE FOR HOT DIP GALVANIZED SUBSTRATES

| | Hot Dip Galvanized Substrate | | | | | | | |
|---|---|---|---|---|---|---|---|---|
| | GSC | | FSC | | ASC | | OSC | |
| Final Rinse | Creepage | Adhesion | Creepage | Adhesion | Creepage | Adhesion | Creepage | Adhesion |
| V (V) #1 | 5 mm | 5 | | | 1 mm | 4 | 1 mm | 4 |
| V (V) #2 | | | 9 mm | 5 | 2 mm | 5 | 1 mm | 4 |
| V (V) #3 | | | 9 mm | 5 | 3 mm | 5 | 1 mm | 4 |
| V (V) #4 | | | 9 mm | 5 | 2 mm | 5 | 2 mm | 4 |
| Positive Controls | | | | | | | | |
| Cr (VI)/Cr (III) | 5 mm | 5 | 10 mm | 5 | 2–3 mm | 4–5 | 0–1 mm | 4 |
| Cr (III) | 4 mm | 5 | 10 mm | 5 | 2 mm | 4–5 | 1–2 mm | 4 |
| Negative Controls | | | | | | | | |

TABLE II-continued

| TEST RESULTS TABLE FOR HOT DIP GALVANIZED SUBSTRATES | | | | | | | | |
|---|---|---|---|---|---|---|---|---|
| | Hot Dip Galvanized Substrate | | | | | | | |
| | GSC | | FSC | | ASC | | OSC | |
| Final Rinse | Creepage | Adhesion | Creepage | Adhesion | Creepage | Adhesion | Creepage | Adhesion |
| No Final Rinse | 5 mm | 4 | 10 mm | 5 | 3 mm | 4–5 | 4–6 mm | 2–3 |

KEY:
Creepage is measured in millimeters from scribe. Adhesion is on a scale of 0 to 5 with 5 being the best.
NOTE:
Ranges given for Chrome (III) and (VI)/(III) and no final rinse are the result of multiple tests of controls.
CONLUSION
The OSC test yielded the only substantial differential between the positive and negative controls. The OSC also showed the four vanadium final rinses to be equivalent to the chrome final rinses of the positive control The GSC, FSC and ASC tests are not helpful in evaluating final rinses because they fail to distinguish the chrome final rinses from no final rinse. The only useful determination that can be made based upon GSC, FSC and ASC is that the tested rinse is or is not detrimental.

TABLE III

| TEST RESULTS FOR ELECTROZINC SUBSTRATES | | | | | | | | |
|---|---|---|---|---|---|---|---|---|
| | Substrate | | | | | | | |
| | GSC | | FSC | | ASC | | OSC | |
| Final Rinse | Creepage | Adhesion | Creepage | Adhesion | Creepage | Adhesion | Creepage | Adhesion |
| V (V) #2A | 2 mm | 4 | 6 mm | 5 | 3 mm | 5 | | |
| V (V) #13 | 2 mm | 4 | 8 mm | 5 | 4 mm | 5 | | |
| Positive Controls | | | | | | | | |
| Cr (VI)/Cr (III) | 2 mm | 4 | 6 mm | 5 | 4 mm | 5 | | |
| Cr (III) | 2 mm | 4 | 8 mm | 5 | 3 mm | 5 | | |
| Negative Controls | | | | | | | | |
| No Final Rinse | 3 mm | 5 | 7 mm | 5 | 4 mm | 5 | | |

KEY:
Creepage is measured in millimeters from scribe. Adhesion is on a scale of 0 to 5 with 5 being the best.
NOTE:
OSC testing is in progress with preliminary visual inspection indicating that the results should be similar to the results of testing on hot dip galvanized substrates.
CONCLUSION
The GSC, FSC and ASC tests are not helpful in evaluating final rinses because they fail to distinguish the chrome final rinses from no final rinse. The only useful determination that can be based upon GSC, FSC and ASC is that the tested rinse is not disadvantageous.

TABLE IV

| OUTDOOR SCAB TESTS OF STEEL SUBSTRATES AND GALVANIZED SUBSTRATES | | | | |
|---|---|---|---|---|
| | Steel Substrate | | Galvanized Substrate | |
| Final Rinse | Creepage | Adhesion | Creepage | Adhesion |
| V (V) #1 | 6 mm | 5 | 1 mm | 4 |
| V (V) #2 | 6 mm | 5 | 1 mm | 4 |
| V (V) #3 | 7 mm | 5 | 1 mm | 4 |
| V (V) #4 | 8 mm (failure) | 5 | 2 mm | 4 |
| V (V) #5 | 8 mm (failure) | 5 | 2 mm | 4 |
| V (V) #6 | 8 mm (failure) | 5 | 2 mm | 4 |
| V (V) #7 | 8 mm (failure) | 5 | 3 mm (failure) | 3 (failure) |
| V (V) #8 | 7 mm | 5 | 1 mm | 4 |
| V (V) #9 | 7 mm | 5 | 1 mm | 5 |
| V (V) #10 | 7 mm | 5 | 1 mm | 5 |
| V (V) #11 | 6 mm | 4 | wide (failure) | 0 (failure) |
| V (V) #12 | 6 mm | 5 | 0 mm | 5 |
| Positive Controls | | | | |
| Cr (VI)/Cr (III) | 7 mm | 5 | 1 mm | 4 |
| | 6 mm | 5 | 0 mm | 4 |
| Cr (III) | 6 mm | 4 | 2 mm | 4 |
| | 6 mm | 5 | 1 mm | 4 |
| Negative Controls | | | | |
| No Final Rinse | 7 mm | 4 | 4 mm | 3 |

TABLE IV-continued

| OUTDOOR SCAB TESTS OF STEEL SUBSTRATES AND GALVANIZED SUBSTRATES | | | | |
|---|---|---|---|---|
| | Steel Substrate | | Galvanized Substrate | |
| Final Rinse | Creepage | Adhesion | Creepage | Adhesion |
| | 6 mm | 5 | 6 mm | 2 |

KEY:
Creepage is measured in millimeters from scribe. Adhesion is on a scale of 0 to 5 with 5 being the best.
CONCLUSION
Galvanized substrates benefitted substantially from the chrome final rinses and equivalent results were achieved with all but two of the vanadium final rinses when tested by the OSC method. The primary conclusion is that many vanadium containing final rinses gave results superior to no final rinse and were as good as the chromium containing final rinses. A secondary conclusion is that vanadium final rinses using citric acid did not perform as well as the chromium final rinses unless ammonium molybdate is added. It also appears that the addition of titanium appears to improve the performance of vanadium on galvanized steel surfaces.

To those knowledgeable in the art of phosphating, it is well known that optimum performance of the phosphate coating is obtained only when an effective final rinse is used. In order for a test procedure to show the relative effectiveness of a final rinse, it must show that the final rinse is comparable to chrome final rinses and that the final rinse is superior to using no final rinse. Results from the GSC, FSC and ASC generally do not show better results when chrome final rinses are used than when no final rinse is used. Therefore, all that these tests can show is that the vanadium final rinses are not detrimental. The OSC does show better results with chrome and several vanadium final rinses than without a final rinse on galvanized substrates.

In test of formulations including citric acid, the reason for less than optimum results is theorized to be due to partial reduction of the vanadium from V (V) to V (IV). This condition may be remedied by decomposing excess acid with an oxidizing agent such as hydrogen peroxide.

Having described the preferred embodiments of the process and composition of this invention, it will be understood that various modifications may be made to the invention disclosed herein within the purview of the appended claims. As described, the invention s intended to be used with cathodically deposited electrocoat paint systems but it is anticipated that comparable results may be achieved with other paint systems.

The final rinses that contain ammonium molybdate and titanium showed some improvements. Molybdate appears to eliminate the detrimental effects on steel of having citric acid present in the working bath. Titanium appears to improve corrosion resistance on galvanized steel surfaces.

What is claimed is:

1. An aqueous solution for rinsing metal surfaces subsequent to a conversion coating, consisting essentially of an aqueous solution including pentavalent vanadium formed from at least one liquid concentrate which when combined in a working bath contains:

(a) from 10 to 100 parts per million a vanadium-containing compound selected from the group consisting of vanadium pentoxide, alkali metal vanadate, ammonium vanadate, vandium pentafluoride, vanadium oxytrichloride, vanadyl-containing species, vanadium tetroxide, vanadium tetrachloride, vanadium tetrafluoride, vanadium trichloride, vanadium dichloride, and vanadium metal;

(b) an alkali selected from the group consisting of alkali metal hydroxide, alkali metal oxide, and ammonium hydroxide; and (c) an acid selected from the group consisting of nitric acid, phosphoric acid, sulfuric acid, hydrofluoric acid, hydrochloric acid, hydrobromic acid, hydroiodic acid, fluoroboric acid, fluosilicic acid, monofluorophosphoric acid, hexafluorophosphoric acid, fluorosulfuric acid, perchloric acid, perbromic acid, periodic acid, phytic acid, carboxylic acid and sulfonic acid, and wherein the aqueous solution has a pH of about 4 to 4.5.

2. An aqueous solution for sealing metal surfaces subsequent to a conversion coating as recited in claim 1 consisting essentially of, in weight percent:

| | |
|---|---|
| 0.0018 to 0.18% | Vanadium Pentoxide |
| 0.0008 to 1.0% | Sodium Hydroxide |
| 0.0010 to 1.0% | Nitric Acid. |

3. An aqueous solution for sealing metal surfaces subsequent to a conversion coating as recited in claim 1 consisting essentially of, in weight percent:

| | |
|---|---|
| 0.005 to 0.04% | Vanadium Pentoxide |
| 0.004 to 0.045% | Sodium Hydroxide |
| 0.005 to 0.05% | Nitric Acid |
| 0.001 to 0.005% | Hydrogen Peroxide (30%). |

4. An aqueous solution for sealing metal surfaces subsequent to a conversion coating as recited in claim1 consisting essentially of, in weight percent:

| | |
|---|---|
| 0.018% | Vanadium Pentoxide |
| 0.001875% | Sodium Hydroxide |
| 0.0118% | Nitric Acid. |

5. An aqueous solution for sealing metal surfaces subsequent to a conversion coating as recited in claim 1 consisting essentially of, in weight percent:

| | |
|---|---|
| 0.0018 to 0.18% | Vanadium Pentoxide |
| 0.0008 to 1.0% | Sodium Hydroxide |
| 0.0010 to 1.0% | Ammonium Bifluoride. |

6. An aqueous solution for sealing metal surfaces subsequent to a conversion coating as recited in claim 5 consisting essentially of, in weight percent:

| | |
|---|---|
| 0.005 to 0.04% | Vanadium Pentoxide |
| 0.004 to 0.045% | Sodium Hydroxide |
| 0.005 to 0.05% | Ammonium Bifluoride |
| 0.001 to 0.005% | Hydrogen Peroxide (30%). |

7. An aqueous solution for sealing metal surfaces subsequent to a conversion coating as recited in claim 1 consisting essentially of, in weight percent:

| | |
|---|---|
| 0.018% | Vanadium Pentoxide |
| 0.001875% | Sodium Hydroxide |
| 0.0117% | Ammonium Bifluoride. |

8. A concentrate for making an aqueous solution for the treatment of conversion coated metal surfaces, said aqueous solution having pentavalent vanadium ions, said concentrate comprising:

(a) a first aqueous solution consisting essentially of alkali metal hydroxide, and from 10 to 1000 parts per million vanadium pentoxide, said first solution being diluted with water to form a working bath; and (b) a second aqueous solution consisting essentially of at least one member selected from the group consisting of nitric acid, ammonium bifluoride, and glycolic acid, said second solution being added to said working bath to lower the pH of the working bath to about 4 to 4.5.

9. The concentrate of claim 8 wherein said first solution is diluted on a volume to volume basis at a ratio of from 1 part per 80 to 1 part per 8000.

10. The concentrate of claim 8 wherein said first solution is diluted on a volume to volume basis at a ratio of from 1 part per 180 to 1 part 1600.

11. The concentrate of claim 8 wherein said first solution is diluted on a volume to volume basis at a ratio of about 1 part per 800.

12. The concentrate of claim 8 wherein said first solution comprises consisting essentially of, in weight percent:

12.8% vanadium pentoxide,
6.2% sodium hydroxide,
0.8% hydrogen peroxide,
80.1% water; and said second solution comprises:

31.2% nitric acid
68.8% water.

13. The concentrate of claim 8 wherein said first solution consisting essentially of, in weight percent:

12.8% vanadium pentoxide,
6.2% sodium hydroxide,
0.8% hydrogen peroxide,
80.1% water; and said second solution comprises:

31.3% ammonium bifluoride
68.7% water.

* * * * *

UNITED STATES PATENT AND TRADEMARK OFFICE

CERTIFICATE OF CORRECTION

PATENT NO. : 4,828,615

DATED : May 9, 1989

INVENTOR(S) : Thomas W. Cape

It is certified that error appears in the above-identified patent and that said Letters Patent is hereby corrected as shown below:

Claim 1 (column 13, line 26), the word "vandium" should read --vanadium--.

Claim 12 (column 14, line 51), "comprises" should be deleted. Also in claim 12 (line 57), "comprises" should be deleted and replaced with --consisting essentially of, in weight percent--.

Claim 13 (column 14, line 65), "comprises" should be deleted and replaced with --consisting essentially of, in weight percent--.

Signed and Sealed this

Twenty-seventh Day of March, 1990

*Attest:*

JEFFREY M. SAMUELS

*Attesting Officer*

*Acting Commissioner of Patents and Trademarks*